US012145186B2

(12) United States Patent
Noh et al.

(10) Patent No.: US 12,145,186 B2
(45) Date of Patent: Nov. 19, 2024

(54) APPARATUS FOR FORMING FLANGE OF CIRCULAR DUCT

(71) Applicants: Sung Keun Noh, Suwon-si (KR); Ok Tae Kim, Yongin-si (KR)

(72) Inventors: Sung Keun Noh, Suwon-si (KR); Ok Tae Kim, Yongin-si (KR)

( * ) Notice: Subject to any disclaimer, the term of this patent is extended or adjusted under 35 U.S.C. 154(b) by 137 days.

(21) Appl. No.: 17/758,112

(22) PCT Filed: Jan. 6, 2021

(86) PCT No.: PCT/KR2021/000101
§ 371 (c)(1),
(2) Date: Jun. 28, 2022

(87) PCT Pub. No.: WO2021/182734
PCT Pub. Date: Sep. 16, 2021

(65) Prior Publication Data

US 2023/0030153 A1 Feb. 2, 2023

(30) Foreign Application Priority Data

Mar. 10, 2020 (KR) ..... 10-2020-0029650

(51) Int. Cl.
*B21D 19/04* (2006.01)
*B21D 19/08* (2006.01)
*B21D 37/10* (2006.01)

(52) U.S. Cl.
CPC ..... *B21D 19/046* (2013.01); *B21D 19/08* (2013.01); *B21D 37/10* (2013.01)

(58) Field of Classification Search
CPC ..... B21D 19/046; B21D 19/08; B21D 19/088
See application file for complete search history.

(56) References Cited

U.S. PATENT DOCUMENTS 7,257,975 B1 * 8/2007 Stauffacher ..... B21D 19/046 72/120
2019/0299264 A1 10/2019 Yoo et al.
2022/0184681 A1 * 6/2022 Noh ..... B21D 39/02

FOREIGN PATENT DOCUMENTS

EP 2732888 A1 * 5/2014 ..... B21D 19/046
JP 2000-271677 A 10/2000
(Continued)

OTHER PUBLICATIONS

Supplementary European Search Report dated Nov. 25, 2022 in European Application No. 21767822.6.
(Continued)

*Primary Examiner* — Mohammed S. Alawadi
(74) *Attorney, Agent, or Firm* — Saliwanchik, Lloyd & Eisenschenk

(57) ABSTRACT

The present disclosure relates to an apparatus for forming flange of circular duct, and the apparatus for forming flange of circular duct according to the present disclosure includes a forming jig that is disposed to surround an outer circumference of a lower end portion of a duct, and that has a forming groove on a surface facing the duct; a support that supports a lower end of the duct below the forming jig; a height adjustor that adjusts height of the support; and a forming unit that hits an inner circumference of the lower end portion of the duct to form a flange having a shape corresponding to the forming groove of the forming jig on the lower end portion of the duct, wherein the forming groove includes a first forming surface formed on the surface facing the duct, and a second forming surface additionally extended from a distal end portion of the first forming surface, and the height adjustor is configured to adjust a relative position of the support with respect to the forming jig such that the flange is formed only on the first
(Continued)

forming surface or formed on the first forming surface and the second forming surface.

4 Claims, 14 Drawing Sheets

(56) References Cited

FOREIGN PATENT DOCUMENTS

| | | | |
|---|---|---|---|
| JP | 2008-260106 | A | 10/2008 |
| KR | 10-0594623 | B1 | 6/2006 |
| KR | 10-1996208 | B1 | 7/2019 |
| KR | 10-2148627 | B1 | 8/2020 |

OTHER PUBLICATIONS

International Search Report dated Apr. 19, 2021 in International Application No. PCT/KR2021/000101.

* cited by examiner

APPARATUS FOR FORMING FLANGE OF CIRCULAR DUCT

CROSS-REFERENCE TO RELATED APPLICATIONS

This application is the U.S. national stage application of International Patent Application No. PCT/KR2021/000101, filed Jan. 6, 2021, which claims the benefit under 35 U.S.C. § 119 of Korean Application No. 10-2020-0029650, filed Mar. 10, 2020, the disclosures of each of which are incorporated herein by reference in their entirety.

TECHNICAL FIELD

The present disclosure relates to an apparatus for forming flange of circular duct, and more particularly, to an apparatus for forming flange of circular duct, that is capable of forming flanges formed at both end portions of the duct, using just one apparatus, where the flanges have different shapes from each other, for coupling between the ducts.

BACKGROUND

In general, a duct is an air container made as a duct connector for ventilation or circulation of air, in order to protect the respiratory system of a person using a public facility, residence, or multipurpose facility such as ground floor mall, from indoor pollutants such as carbon dioxide and harmful bacteria. It refers to a part of the composition of an air conditioning facility.

As structures of facilities become more and more complex and diverse due to the trend of designing a facility with its convenience and design in mind, the structures of ducts are also becoming more and more complex and diverse.

In line with the complex structures of facilities as described above, duct manufacturing companies are manufacturing various kinds of ducts such as circular ducts, T-shaped ducts, Y-shaped ducts, elbow-shaped ducts and the like in consideration of the purpose, location, size and the like of the ducts.

Patent literature 1 (Republic of Korea Patent Publication No. 10-0846878) relates to an apparatus for forming flange of circular duct, which can bend both end portions of a circular tube for a duct with precision.

In general, for coupling between the unit elements of a duct, a flange having a first shape consisting of a horizontal element should be formed at one end portion of the duct, and a flange having a second shape consisting of horizontal and vertical elements should be formed at the other end portion of the duct, and then after that, the flange having the first shape and the flange having the second shape of one pair of adjacent duct unit elements should be joined together.

However, a forming apparatus according to prior art can only form the flange having the first shape consisting of the horizontal element, and thus there is a problem that the flange having the second shape consisting of the horizontal and vertical elements for coupling of the ducts has to be formed by another forming apparatus.

That is, according to the forming apparatus of Patent literature 1, after the flange having the first shape is formed at one end portion of the duct, the duct of which the forming has been completed has to be transferred to another forming apparatus installed in another place so that the flange having the second flange can be formed in the other forming apparatus, and thus there is a problem that, not only does this take up a lot of space, but it also lowers production efficiency.

DETAILED DESCRIPTION

Problems to be Solved

Therefore, a purpose of the present disclosure is to resolve the problems of prior art mentioned above, that is, to provide an apparatus for forming flange of circular duct, that is capable of forming flanges formed at both end portions of the duct using just one apparatus, where the flanges have different shapes from each other, for coupling between the ducts.

Further, another purpose of the present disclosure is to provide an apparatus for forming flange of circular duct, where a support for determining the position of a lower end of the duct can stably ascend and descend.

Further, another purpose of the present disclosure is to provide an apparatus for forming flange of circular duct, where the fixing device and forming jig are configured to be divided into plurality, and closely contact each other in a state where the duct is fixed and the fixed position of the duct is guided, and thus the outer appearance of the duct is inhibited from being deformed by the fixing pressure of the fixing device.

Technical Solutions

The aforementioned purposes are achieved by an apparatus for forming flange of circular duct including a forming jig that is disposed to surround an outer circumference of a lower end portion of a duct, and that has a forming groove on a surface facing the duct; a support that supports a lower end of the duct below the forming jig; a height adjustor that adjusts height of the support; and a forming unit that hits an inner circumference of the lower end portion of the duct to form a flange having a shape corresponding to the forming groove of the forming jig on the lower end portion of the duct, wherein the forming groove includes a first forming surface formed on the surface facing the duct, and a second forming surface additionally extended from a distal end portion of the first forming surface, and the height adjustor is configured to adjust a relative position of the support with respect to the forming jig such that the flange is formed only on the first forming surface or formed on the first forming surface and the second forming surface.

Here, it is preferable that the height adjustor includes an ascending and descending support that is provided in plurality around the duct and of which an upper end portion supports a lower portion of the support; a connecting shaft that is disposed in a direction intersecting the ascending and descending support and that connects one pair of adjacent ascending and descending supports; and a driving motor that provides rotation driving force to the connecting shaft, and that the ascending and descending support is supported in an ascendable and descendible state, and the connecting shaft is supported in an axially rotatable state, and a rack and a pinion are formed at a position where the connecting shaft and the ascending and descending support are connected to be engaged to each other.

Further, it is preferable that the first forming surface is formed in a direction intersecting a longitudinal direction of the duct, and the second forming surface is formed in a direction parallel with the longitudinal direction of the duct.

Further, it is preferable that the apparatus for forming flange of circular duct includes a fixing device that selectively fixes the duct on the forming jig.

Further, it is preferable that the forming jig and the fixing device are configured to be divided into plurality, and that the forming jigs and fixing devices divided into plurality have side surfaces that closely contact each other at a position where the duct is fixed, so that the fixed position of the duct is guided.

Further, it is preferable that the fixing device includes a duct fixture that supports an outer side surface of the duct; a guide that supports the duct fixture to be movable in a radial direction of the duct; and an actuator that moves the duct fixture.

Further, it is preferable that the forming unit includes a forming tool that hits an inner circumference of the duct at a position corresponding to the forming groove while going around along the inner circumference of the duct, thereby forming the flange; and a power mechanism that provides power for rotation and back and forth movement of the forming tool.

Effects

Therefore, according to the present disclosure, an apparatus for forming flange of circular duct is provided, that is capable of forming flanges formed at both end portions of the duct using just one apparatus, where the flanges have different shapes from each other for coupling between the ducts.

Further, an apparatus for forming flange of circular duct is provided, where a support that determines a position of the lower end of the duct can stably ascend and descend.

Further, an apparatus for forming flange of circular duct is provided, where the fixing device and forming jig are configured to be divided into plurality, and closely contact each other in a state where the duct is fixed, and the fixed position is guided, thus an outer appearance of the duct being inhibited from being deformed by a fixing pressure of the fixing device.

REFERENCE NUMERALS

Figure 1:
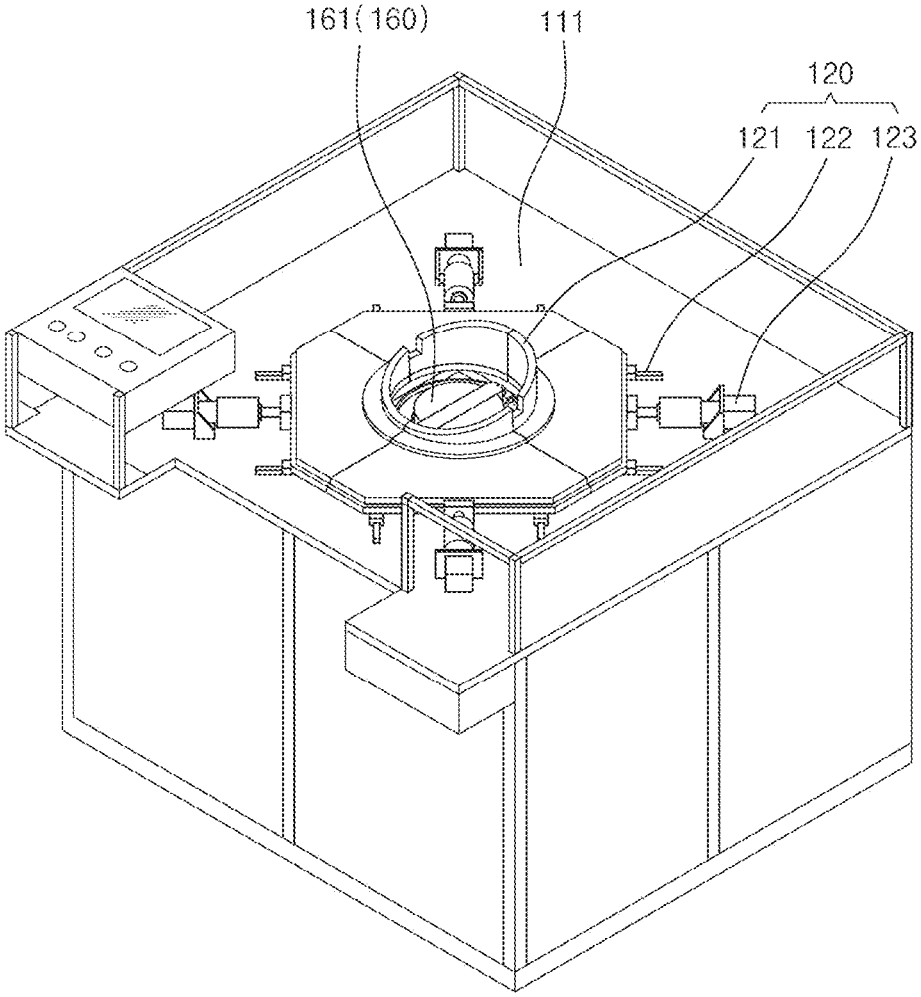
FIG. 1 is a perspective view of an apparatus for forming flange of circular duct of the present disclosure.

111: FIRST BASE, 111A: THROUGH HOLE, 112: SECOND BASE,
120: FIXING DEVICE, 121: DUCT FIXTURE, 122: GUIDE,
123: ACTUATOR, 130: SUPPORT, 131: SEAT PART,
140: HEIGHT ADJUSTOR, 141: ASCENDING AND DESCENDING SUPPORT, 141*a*: RACK,
142: CONNECTING SHAFT, 142*a*: PINION, 143: DRIVING MOTOR,
144: HOUSING, 150: FORMING JIG, 151: FIRST FORMING SURFACE,
152: SECOND FORMING SURFACE, 160: FORMING UNIT, 161: FORMING TOOL,
D: DUCT, F1: FIRST SHAPE FLANGE, F2: SECOND SHAPE FLANGE.

Embodiments

Prior to the description, it should be noted that in various embodiments, components having the same configuration will be representatively described in a first embodiment using the same reference numerals, and in other embodiments, components having different configurations from the first embodiment will be described.

Hereinbelow, an apparatus for forming flange of circular duct according to the first embodiment of the present disclosure will be described in detail with reference to the drawings attached.

Figure 2:
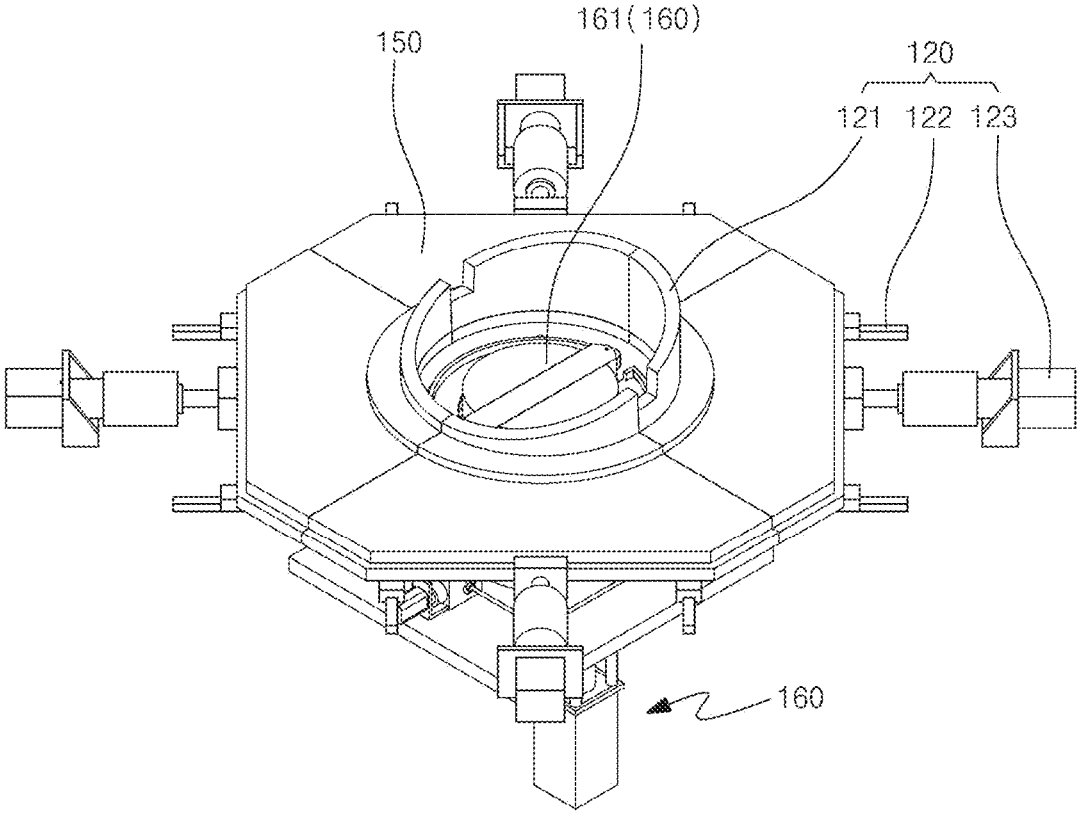
FIG. 2 is an excerpt perspective view showing the main configuration of the apparatus for forming flange of circular duct of the present disclosure.
Figure 3:
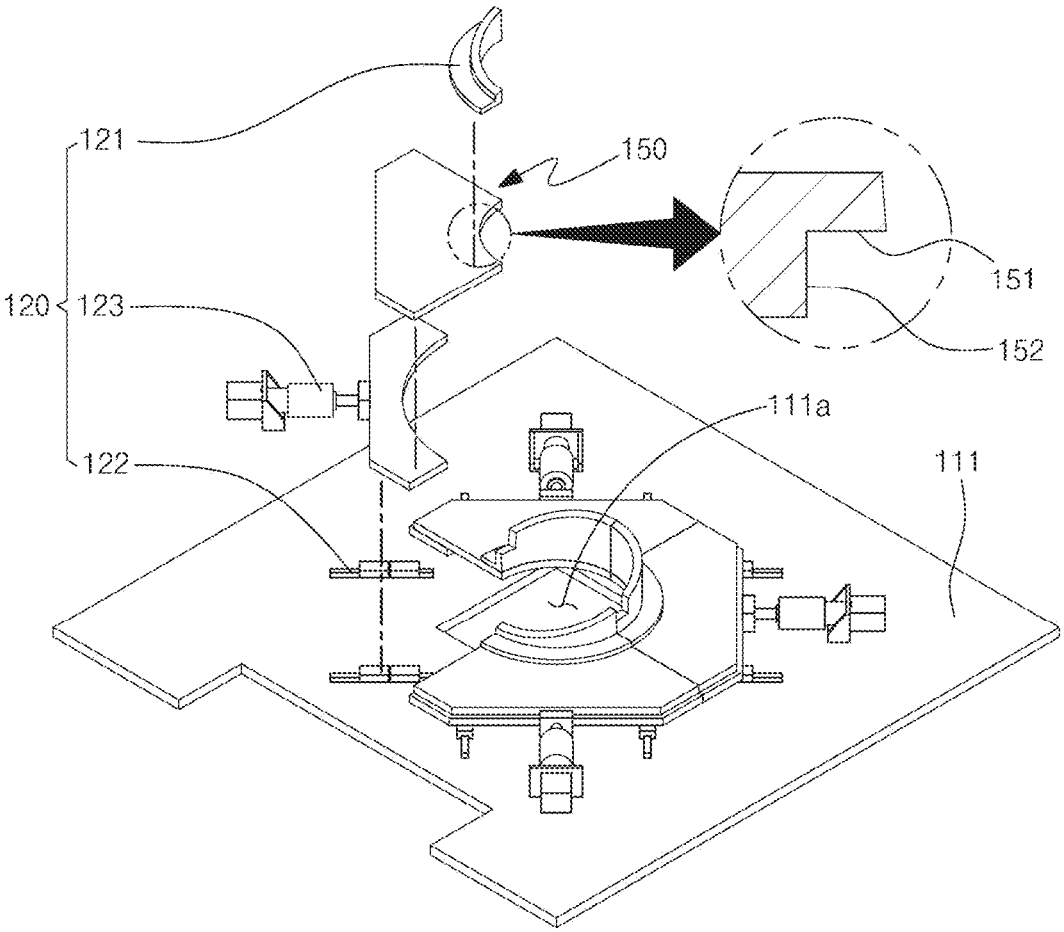
FIG. 3 is an excerpt perspective view of a fixing device and a forming jig according to the apparatus for forming flange of circular duct of the present disclosure.
Figure 4:
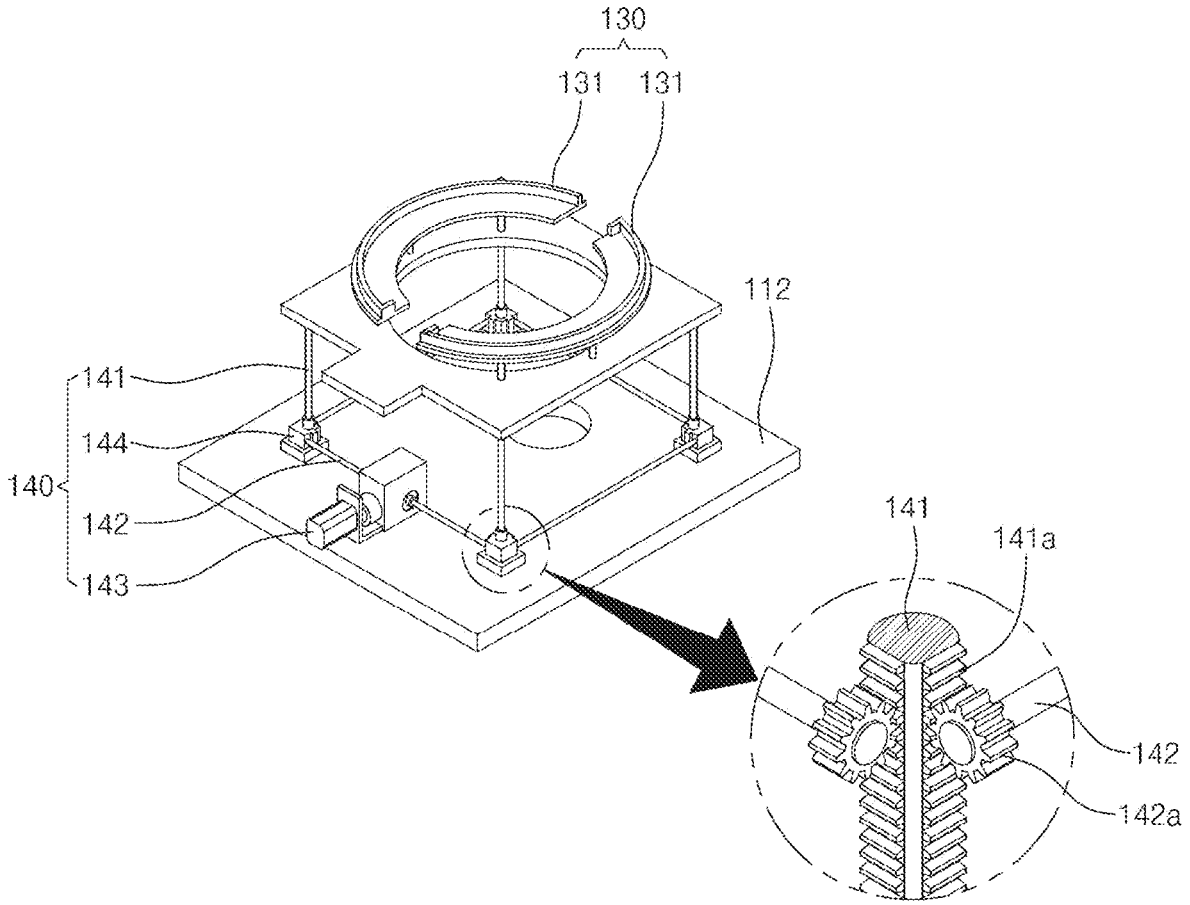
FIG. 4 is an excerpt perspective view of a height adjustor according to the apparatus for forming flange of circular duct of the present disclosure.
Figure 5:
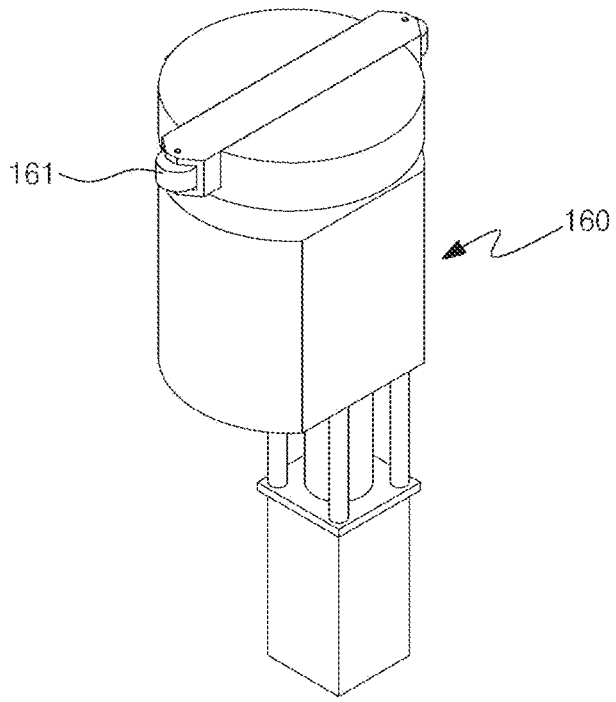
FIG. 5 is an exploded perspective view of a forming unit according to the apparatus for forming flange of circular duct of the present disclosure.

Of the drawings attached, FIG. 1 is a perspective view of an apparatus for forming flange of circular duct of the present disclosure, FIG. 2 is an excerpt perspective view showing the main configuration of the apparatus for forming flange of circular duct of the present disclosure, FIG. 3 is an excerpt perspective view of a fixing device and a forming jig according to the apparatus for forming flange of circular duct of the present disclosure, FIG. 4 is an excerpt perspective view of a height adjustor according to the apparatus for forming flange of circular duct of the present disclosure, and FIG. 5 is an exploded perspective view of a forming unit according to the apparatus for forming flange of circular duct of the present disclosure.

As illustrated in the above-mentioned drawings, the apparatus for forming flange of circular duct of the present disclosure includes a base, a fixing device 120, a support, 130, a height adjustor 140, a forming jig 150 and a forming unit 160.

The base includes a first base 111 where a through hole 111*a* is formed in the center, and a second base 112 disposed below the through hole 111*a* of the first base 111. The first base 111 and the second base 112 are connected through a plurality of pillar members.

The fixing device 120 is for selectively fixing the duct D, and is provided in plurality and is radially disposed around the through hole 111*a* on an upper side of the first base 111.

Such a fixing device 120 includes a duct fixture 121 that can support an outer side surface of the duct D, a guide 122 that supports the duct fixture 121 to be moveable in a radial direction of the duct D on the first base 111, and an actuator 123 that moves the duct fixture 121. The guide 122 may consist of two or more rows of LM guides disposed side by side, and the actuator 123 may consist of a pneumatic cylinder in which a cylinder rod contracts or extends by pneumatic pressure. Therefore, during an extension drive of the actuator 123, the duct fixture 121 pressurizes and supports the outer side surface of the duct D to fix the same, and during a contraction drive of the actuator 123, the duct fixture 121 is spaced apart from the outer side surface of the duct D, to release the fixation.

Meanwhile, the duct fixture 121 is equipped with an arc-shaped close contact surface that can support the outer side surface of the duct D, and is configured such that in a state where the plurality of duct fixtures 121 each moves forth to support the outer side surface of the duct D, a side surface contacts a side surface of an adjacent duct fixture 121, and thus not only can the fixing position of the duct D have a constant alignment, but it is also possible to inhibit the outer appearance of the duct D from being deformed by the fixing pressure of the fixing device 120. That is, the space surrounded by the plurality of duct fixtures is set to correspond to the outer appearance of the duct D in a state where the side surfaces of the plurality of duct fixtures 121 contact each other.

The forming jig 150 is equipped with a forming groove on a surface facing the duct D, and is disposed to surround an outer circumference of a lower end portion of the duct D below the duct fixture 121. In the present embodiment, it is exemplified that the forming jig 150 is divided into plurality to correspond to the number of the fixing devices 120, each of the divided forming jig 150 disposed between the duct fixture 121 of the fixing device 120 and the actuator 123, to move along the guide 122 together with the duct fixture 121.

The forming groove includes a first forming surface 151 that extends from the surface facing the duct D in a horizontal direction that intersects a longitudinal direction of the duct D, and a second forming surface 152 that extends from a distal end portion of the first forming surface 151 in a vertical direction that is parallel with the longitudinal direction of the duct D, and overall has a rough shape of the letter 'ㄱ'. Accordingly, a flange F1 formed in the first forming surface 151 may have a first shape that has only a horizontal element, whereas a flange F2 formed in the first forming surface 151 and the second forming surface 152 may have a second shape that has horizontal and vertical elements.

The support 130 includes an arc shaped seat part 131 disposed below the forming jig 150 in order to support the lower end of the duct D. The support 130 is provided in plurality, each disposed at either side below the forming jig 150, and between the seat parts 131 at either side, a separation space is provided, in which a forming tool 161 of the forming unit 160 may be disposed.

The height adjustor 140 is provided between the second base 112 and the support 130, to adjust the height of the support 130 that supports the lower end of the duct D, and by the position of the support 130, the relative position of the lower end portion of the duct D with respect to the forming jig 150 may be determined.

Such a height adjustor 140 includes a plurality of ascending and descending supports 141 of which the upper end portion supports the lower portion of the support 130, a connecting shaft 142 that is disposed in a direction intersecting the ascending and descending support 141 and that connects one pair of adjacent ascending and descending supports 141, a driving motor 143 that provides rotation driving force to the connecting shaft 142, and a housing 144 that surrounds a connecting portion of the ascending and descending support 141 and the connecting shaft 142.

Meanwhile, in the drawings of the present embodiment, it is illustrated that the support 130 consists of a plurality of seat parts 131, and thus such a plurality of seat parts 131 are supported by one plate, and the plate may ascend and descend by the height adjustor 140, but there is no limitation thereto.

Further, the ascending and descending support 141 is supported on the housing 144 in an ascendible and descendible state, and the connecting shaft 142 is supported on the housing 144 in an axially rotatable state, and on the connecting portion of the connecting shaft 142 and the ascending and descending support 141, a rack 141A and a pinion 142A are formed to be engaged to each other. Accordingly, when the plurality of ascending and descending supports 141 are connected by the connecting shaft 142 and thus are interlocked to each other, and any one of the connecting shaft 142 is rotated, the plurality of ascending and descending supports 141 will be interlocked in the rotating direction of the connecting shaft 142, thus ascending or descending together.

Meanwhile, a speed reducer for reducing the rotation speed of the driving motor 143 and increasing the driving torque may be disposed between the driving motor 143 and the connecting shaft 142.

The forming unit 160 is for hitting an inner circumference of the lower end portion of the duct D to form flanges F1, F2 having shapes that correspond to the forming groove of the forming jig 150 on the lower end portion of the duct D, and the forming unit 160 includes a forming tool 161 that hits the inner circumference of the duct D of a position corresponding to the forming groove while going round along the inner circumference of the duct D, and a power mechanism for rotation and back and forth of the forming tool 161.

The power mechanism includes a first rotation mechanism that rotates on a same axis as the center of the duct D, a second rotation mechanism that is disposed on a same axis as the first rotation mechanism and has a different number of rotations from the first rotation mechanism, and a rotation housing being rotated by the first rotation mechanism, and the forming tool 161 is configured so that it is supported to be movable in straight lines in both directions on the rotation housing and rotates by the first rotation mechanism while going around along the inner circumference of the duct (D) while moving back and forth by the second rotation mechanism, thus hitting the inner circumference of the duct D repeatedly. Such a configuration and action of the forming unit 160 was disclosed by Patent Publication No. 10-2016-0034581 (Mar. 30, 2016) and Patent Publication No. 10-2054442 (Dec. 10, 2019), and thus detailed description thereof will be omitted.

That is, according to the present embodiment, the height of the support 130 may be changed to a first position and a second position using the height adjustor, and in a state where the support 130 moved to the first position, as the lower end portion of the duct D is formed only in a first forming surface 151, a flange F1 having a first shape F1 may be formed on the lower end of the duct D, and in a state where the support 130 moved to the second position, as the lower end portion of the duct D is formed on the first forming surface 151 and the second forming surface 152, a flange F2 having a second shape may be formed on the lower end of the duct D.

From now, action of the first embodiment of the apparatus for forming flange of circular duct mentioned above will be described.

Figure 6:
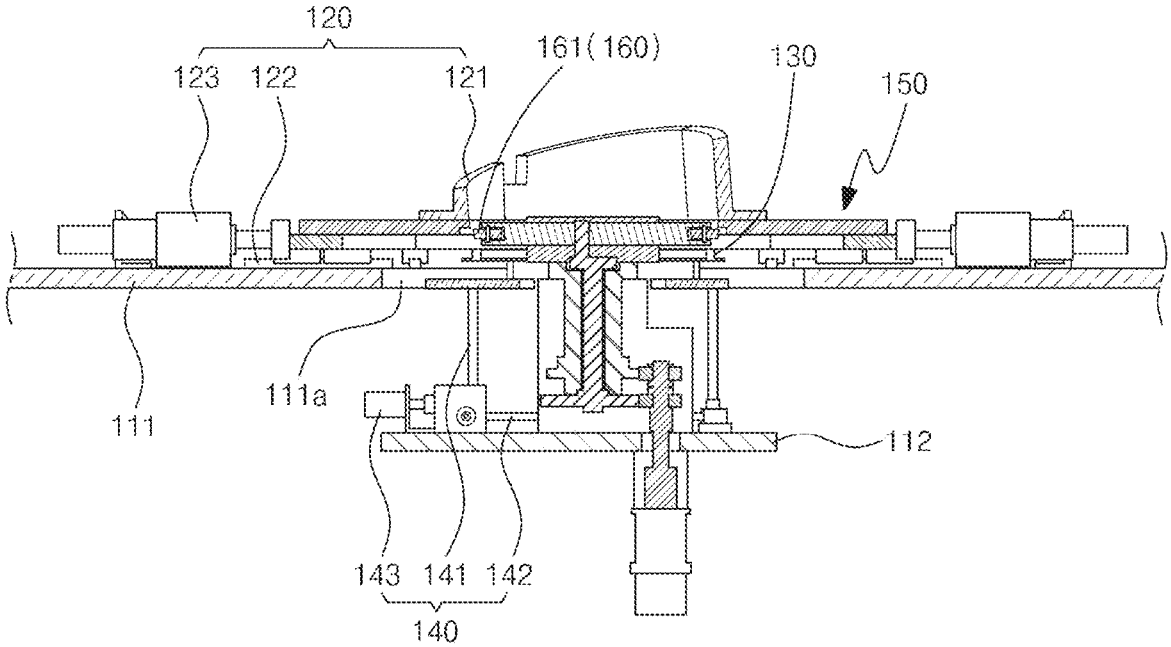
FIG. 6 is a cross-sectional view of the apparatus for forming flange of circular duct of the present disclosure.
Figure 7:
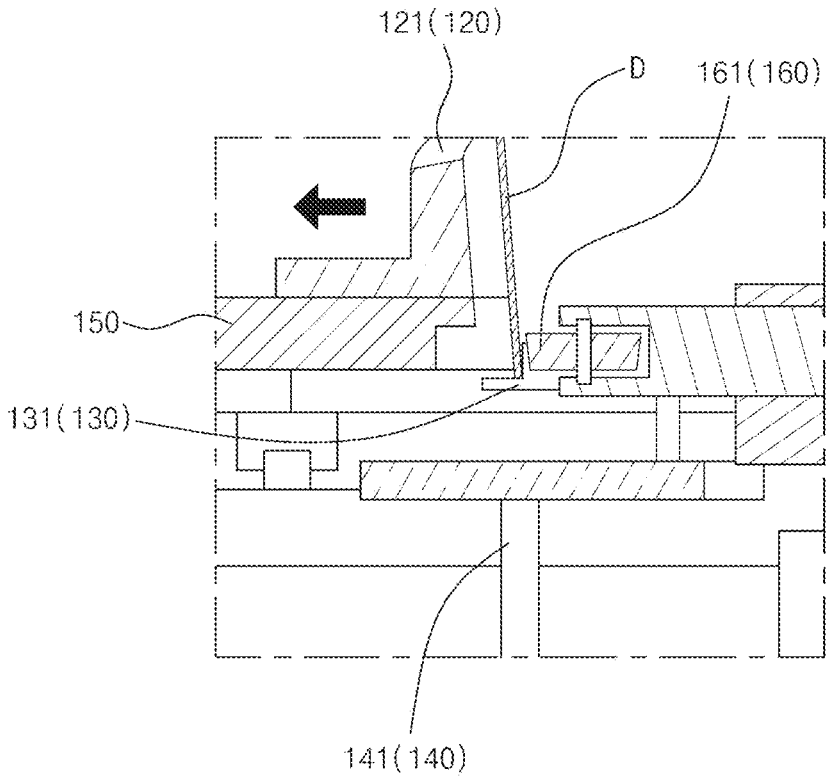
FIG. 7 is view showing a state where a support according to the apparatus for forming flange of circular duct of the present disclosure moved to a first position.
Figure 8:
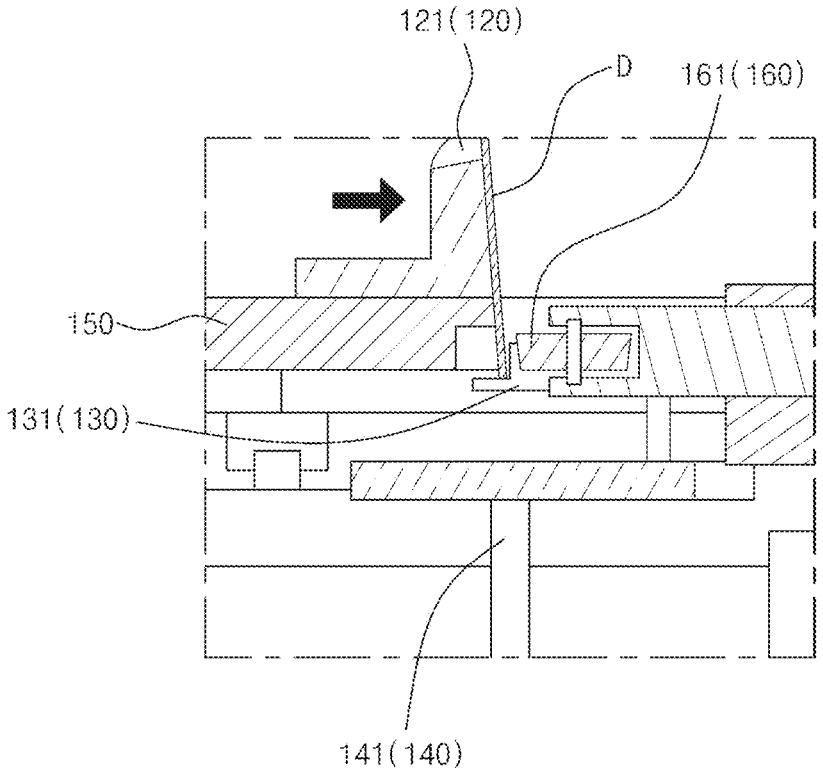
FIG. 8 is a view showing a state where the duct is fixed using the fixing device according to the apparatus for forming flange of circular duct of the present disclosure.
Figure 9:
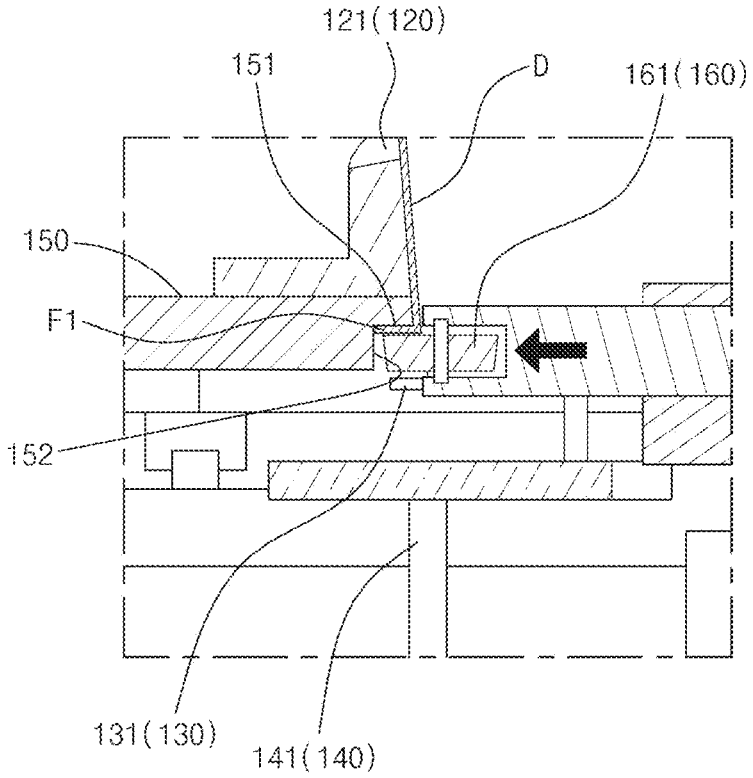
FIG. 9 is a view showing a state of forming the flange having a first shape using the forming unit according to the apparatus for forming flange of circular duct of the present disclosure.
Figure 10:
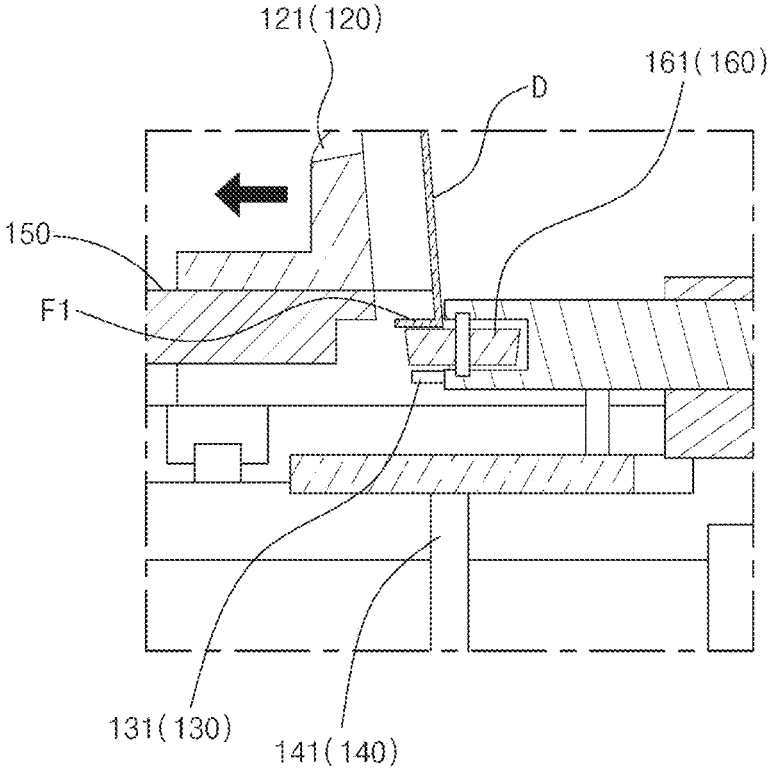
FIG. 10 is a view showing a state where the duct is released from fixation using the fixing device according to the apparatus for forming flange of circular duct of the present disclosure.
Figure 11:
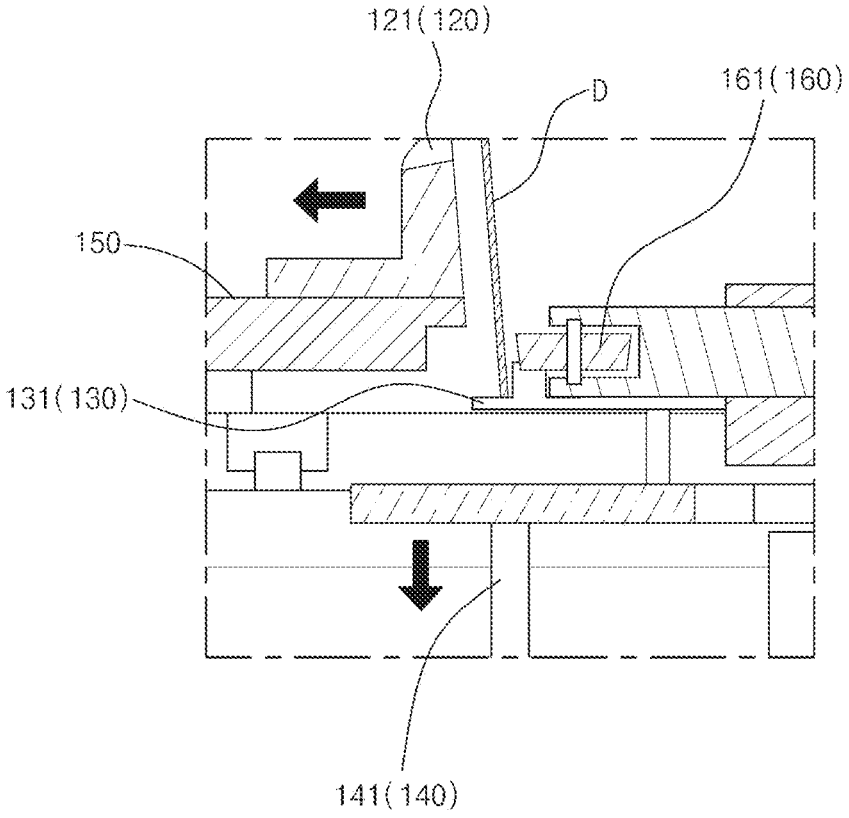
FIG. 11 is a view showing a state where the support according to the apparatus for forming flange of circular duct of the present disclosure moved to a second position.
Figure 12:
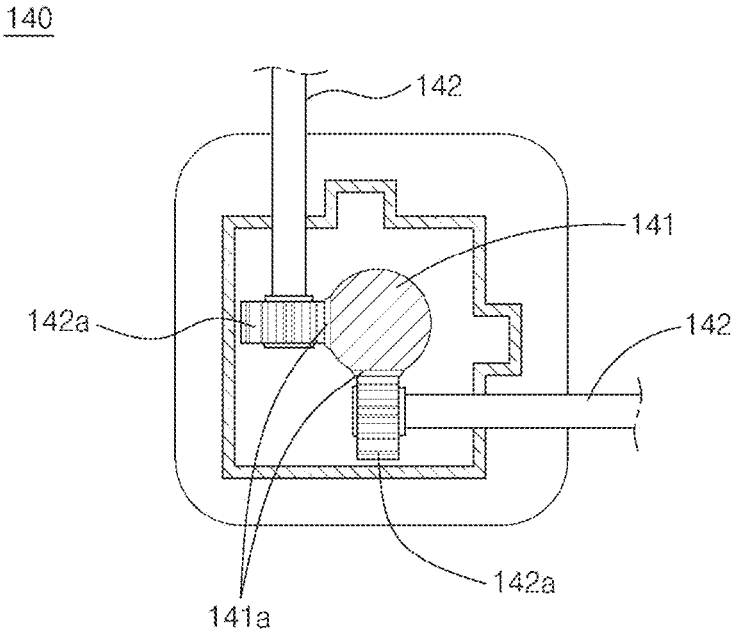
FIGS. 12(*a*) and 12(*b*) are views showing the action of the height adjustor according to the apparatus for forming flange of circular duct of the present disclosure.
Figure 12:
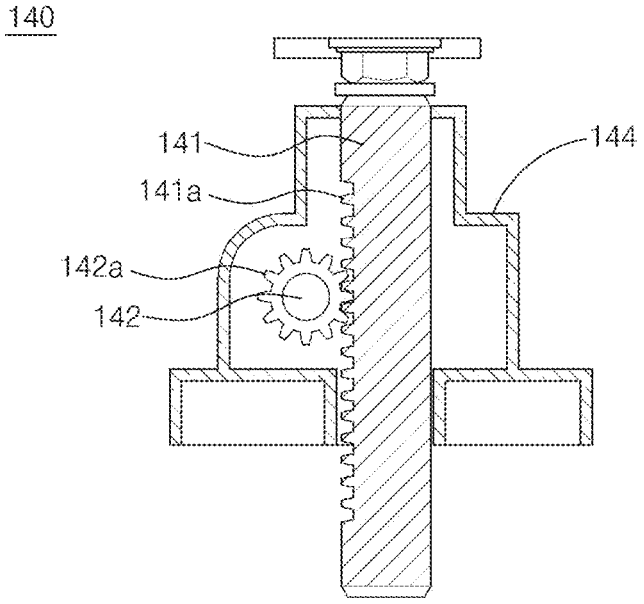
Figure 13:
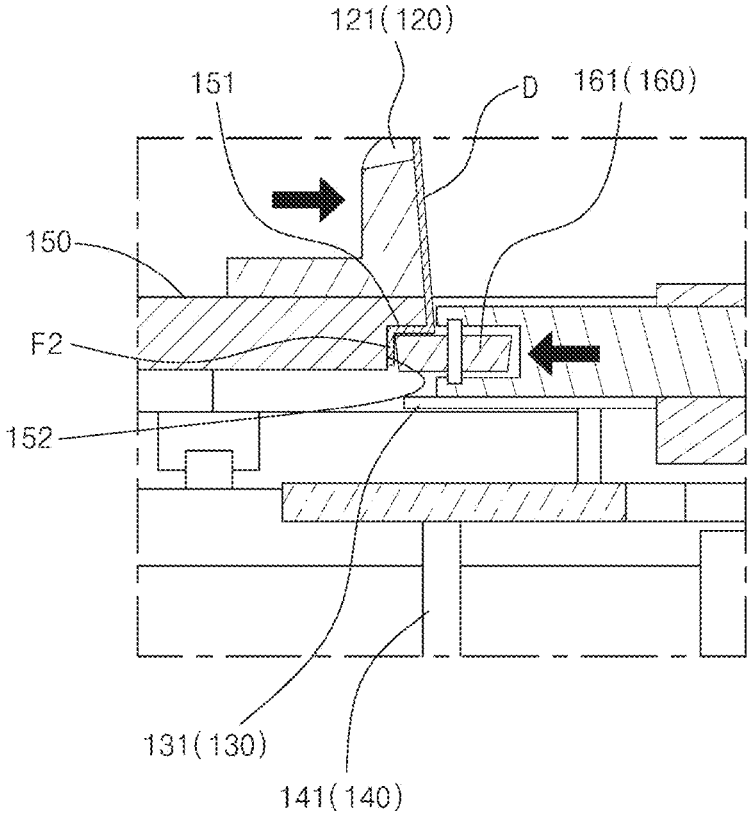
FIG. 13 is a view showing a state of forming a flange having a second shape using the forming unit according to the apparatus for forming flange of circular duct of the present disclosure.
Figure 14:
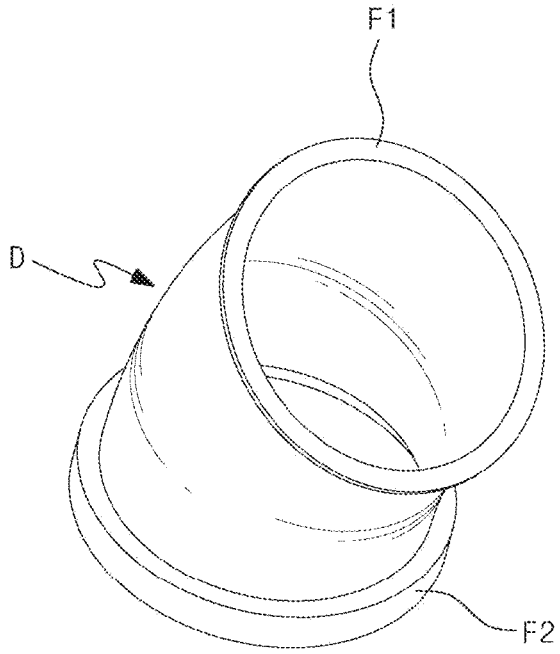
FIGS. 14(*a*) and 14(*b*) are views showing a duct of which the forming of flange is completed by the apparatus for forming flange of circular duct of the present disclosure.
Figure 14:
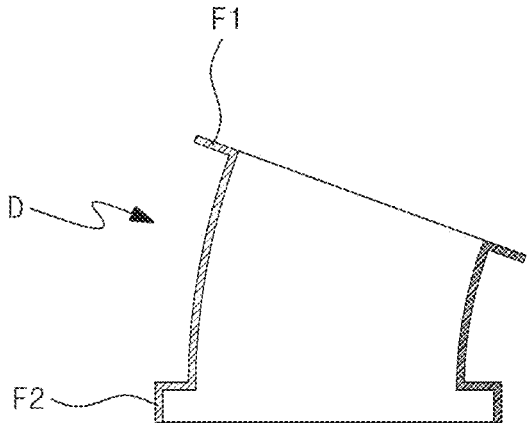

Of the drawings attached, FIG. 6 is a cross-sectional view of the apparatus for forming flange of circular duct of the present disclosure, FIG. 7 is view showing a state where a support according to the apparatus for forming flange of circular duct of the present disclosure moved to a first position, FIG. 8 is a view showing a state where the duct is fixed using the fixing device according to the apparatus for forming flange of circular duct of the present disclosure, FIG. 9 is a view showing a state of forming the flange having a first shape using the forming unit according to the apparatus for forming flange of circular duct of the present disclosure, FIG. 10 is a view showing a state where the duct is released from fixation using the fixing device according to the apparatus for forming flange of circular duct of the present disclosure, FIG. 11 is a view showing a state where the support according to the apparatus for forming flange of circular duct of the present disclosure moved to a second position, FIGS. 12(*a*) and 12(*b*) are views showing the action of the height adjustor according to the apparatus for forming flange of circular duct of the present disclosure, FIG. 13 is a view showing a state of forming a flange having a second shape using the forming unit according to the apparatus for forming flange of circular duct of the present disclosure, and FIGS. 14(*a*) and 14(*b*) are views showing a duct of which the forming of flange is completed by the apparatus for forming flange of circular duct of the present disclosure.

First of all, as illustrated in FIG. 6, the fixing device 120 is disposed in plurality around a fixing area of the duct D on an upper side of the first base 111, and the position of the support 130 may be adjusted up and down by the height adjustor 140 provided between the second base 112 and the support 130 below the fixing area of the duct D, and the forming jig 150 is disposed to surround an outer side of a lower portion of the fixing area of the duct D, and the forming unit 160 is disposed in a position corresponding to the forming jig 150 at a center of the fixing area of the duct D.

Prior to inserting the duct D into the duct D fixing area, as each actuator 123 contracts, the duct fixture 121 of the fixing device 120 will be in a backed state as shown in FIG. 7, and thus the duct D may be inserted into a space between the plurality of duct fixtures 121, and when one end portion of the duct D that is the subject of forming is inserted into the fixing area, as the lower end of the duct D is seated on the support 130, the insertion length of the duct D will be guided.

The support 130 may move to either one position of the first position and the second position by the height adjustor 140, and FIGS. 6 and 7 show the state where the support 130 moved to the first position.

After the lower end of the duct D is seated on the support 130 as mentioned above, the duct D is fixed using the fixing device 120. That is, when the actuator 123 is extended to advance the duct fixture 121 as shown in FIG. 8, as the duct fixture 121 is closely supported against the outer side surface of the duct D, the position of the duct D may be fixed. Therefore, it is possible to inhibit the duct D from arbitrarily moving in a process of forming a flange F1 on the lower end of the duct D afterwards.

Next, as shown in FIG. 9, when the forming unit 160 is driven, in a process where the forming tool 161 goes around along the inner circumference of the duct D, as the forming tool 161 hits the inner circumference of the lower end portion of the duct D while repeating back and forth, the lower end of the duct D is bent to correspond to the forming groove of the forming jig 150, and thus the flange F1 is formed.

That is, the support 130 supports the lower end of the duct D in the first position, and such a first position is set such that forming can be performed only by the first forming surface 151 in the process the lower end portion of the duct D is bent by the forming tool 161. Therefore, in a state where the support 130 moved to the first position, the flange F1 having the first shape that has only the horizontal element at one end portion of the duct D, will be formed.

Meanwhile, after the forming tool 161 goes around along the inner circumference of the duct D to complete the forming of the flange F1, as shown in FIG. 10, when the actuator 123 of the fixing device 120 contracts to back the duct fixture 121 thereby releasing the fixation of the duct D, a duct D of which forming of the flange F1 is completed, may be drawn out.

Meanwhile, for coupling between the unit elements of the duct D, on the other end portion of the duct D, the flange F2 having the second shape needs to be formed.

For forming of such a flange F2 having the second shape, as shown in FIG. 11, the height adjustor 140 is used to descend the support 130, thereby adjusting the height of the support 130 to the second position.

Such a height adjustor 140 consists of a plurality of ascending and descending supports 141, and a connecting shaft 142 for connecting one pair of adjacent ascending and descending supports 141. Here, since the plurality of ascending and descending supports 141 are connected by the connecting shaft 142 and are thus interlocked to each other, the height of the support 130 may be easily adjusted.

Looking at the connecting portion of the ascending and descending support 141 and the connecting shaft 142, as shown in FIGS. 12(*a*) and 12(*b*), at one end portion of the connecting shaft 142, a pinion 142A is formed, and at one side surface of the ascending and descending support 141, a rack 141A that engages with the pinion 142A, is formed. Further, since a plurality of connecting shafts 142 are connected to one ascending and descending support 141, by the rotation force provided through the connecting shaft 142 at one side, the ascending and descending support 141 may ascend and descend, and by such ascending and descending of the ascending and descending support 141, the connecting shaft 142 at the other side will rotate since it is interlocked, and thus the plurality of ascending and descending supports 141 may ascend or descend at the same time.

In a state where the support 130 moved to the second position by the height adjustor 140 as mentioned above, when the other end portion of the duct D is inserted into the fixing area of the duct D, the lower end portion of the duct D will be seated and supported on the support 130 of the second position.

Thereafter, when the position of the duct D is fixed using the fixing device 120 and then the forming unit 160 is driven, in the process where the forming tool 161 goes around along the inner circumference of the duct D as shown in FIG. 13 and the forming tool 161 repeats back and forth to hit the inner circumference of the lower end portion of the duct D, as the lower end of the duct D is bent to have the shape corresponding to the forming groove of the forming jig 150, the flange F2 will be formed.

That is, the support 130 that moved to the second position is set to be a position that is relatively descended compared to the first position, and thus the support 130 is hit by the forming tool 161, thereby extending the length of the portion of the duct D being inserted into the forming groove, and accordingly, the flange F2 of the second shape having the horizontal element by the first forming surface 151 and the vertical element by the second forming surface 152 may be formed.

Meanwhile, after the forming of the flange F2 having the second shape is completed, when the duct D is released from fixation using the fixing device 120, a duct D of which forming of the flange F2 is completed may be drawn out.

FIGS. 14(*a*) and 14(*b*) show a unit element of the duct D prepared by the apparatus for forming flange of circular duct of the present disclosure, where at one end, the flange F1 of the first shape having the horizontal element is formed, and at the other end, the flange F2 of the second shape having the horizontal and vertical elements is formed.

In a process of connecting a plurality of unit elements of the duct D prepared as mentioned above, by putting the flange F1 of the first shape and the flange F2 of the second shape together, and then bending the vertical element of the flange F2 of the second shape, unit elements of one pair of adjacent ducts D may be coupled.

According to the apparatus for forming flange of circular duct of the present embodiment as mentioned above, flanges F1, F2 having different shapes for coupling between the unit elements of the duct D can be formed respectively in one apparatus for forming flange of the duct D, and thus use efficiency of the apparatus can be improved.

The scope of the present disclosure is not limited to the aforementioned embodiments, but may be implemented in various forms of embodiments within the scope of the claims set attached. Without departing from the gist of the present disclosure claimed in the attached claims set, it is considered to be within the scope of the claims of the present disclosure to various extents that can be modified by anyone with ordinary knowledge in the technical field to which the present disclosure pertains.

What is claimed is:

1. An apparatus for forming a flange of a circular duct, the apparatus comprising:

a forming jig that is disposed to surround an outer circumference of a lower end portion of the circular duct, the forming jig having a forming groove on a surface facing the circular duct;

a support that supports a lower end of the circular duct below the forming jig;

a height adjustor that adjusts height of the support;

a forming unit that hits an inner circumference of the lower end portion of the circular duct such that the flange is formed on the lower end portion of the circular duct, the flange having a shape corresponding to the forming groove of the forming jig; and a fixing device that selectively fixes the circular duct on the forming jig, wherein the forming groove includes a first forming surface formed on the surface facing the circular duct, and a second forming surface extended from a distal end portion of the first forming surface, and wherein the height adjustor is configured to adjust a relative position of the support with respect to the forming jig such that the flange is formed only on the first forming surface or is formed on the first forming surface and the second forming surface, wherein the forming jig is provided as a plurality of forming jigs and the fixing device is provided as a plurality of fixing devices, wherein the forming jigs of the plurality of forming jigs and the fixing devices of the plurality of fixing devices have side surfaces that closely contact each other at a fixed position where the circular duct is fixed, so that the fixed position of the circular duct is guided, and wherein each of the fixing devices includes:

a duct fixture having an arc-shaped close contact surface that supports an outer side surface of the circular duct;

a guide that supports the duct fixture to be movable in a radial direction of the circular duct; and an actuator that moves the duct fixture.

2. The apparatus according to claim 1, wherein the height adjustor includes an ascending and descending support that is provided in plurality around the duct and of which an upper end portion supports a lower portion of the support; a connecting shaft that is disposed in a direction intersecting the ascending and descending support and that connects one pair of adjacent ascending and descending supports; and a driving motor that provides rotation driving force to the connecting shaft, and wherein the ascending and descending support is supported in an ascendable and descendible state, and the connecting shaft is supported in an axially rotatable state, and a rack and a pinion are formed at a position where the connecting shaft and the ascending and descending support are connected to be engaged to each other.

3. The apparatus according to claim 1, wherein the first forming surface is formed in a direction intersecting a longitudinal direction of the duct, and wherein the second forming surface is formed in a direction parallel with the longitudinal direction of the duct.

4. The apparatus according to claim 1, wherein the forming unit includes:

a forming tool that hits an inner circumference of the duct at a position corresponding to the forming groove while going around along the inner circumference of the duct, thereby forming the flange; and a power mechanism that provides power for rotation and back and forth movement of the forming tool.

* * * * *